US006988951B1

(12) United States Patent
Newman et al.

(10) Patent No.: US 6,988,951 B1
(45) Date of Patent: Jan. 24, 2006

(54) FLOATING MACHINE

(76) Inventors: Sven D. Newman, 3311 Alameda De Las Pulgas, Menlo Park, CA (US) 94025; Kevin R. Fine, 3311 Alameda De Las Pulgas, Menlo Park, CA (US) 94025

( * ) Notice: Subject to any disclaimer, the term of this patent is extended or adjusted under 35 U.S.C. 154(b) by 0 days.

(21) Appl. No.: 10/348,132

(22) Filed: Jan. 21, 2003

Related U.S. Application Data

(60) Provisional application No. 60/351,068, filed on Jan. 23, 2002.

(51) Int. Cl.
*A63G 1/24* (2006.01)

(52) U.S. Cl. ..... 472/39; 472/59; 472/46; 472/112; 472/131

(58) Field of Classification Search ..... 472/34, 472/39, 44–47, 50, 112, 131; 434/55, 247
See application file for complete search history.

(56) References Cited

U.S. PATENT DOCUMENTS 1,898,466 A * 2/1933 Pierson ..... 472/112
3,298,685 A * 1/1967 Williams ..... 472/16
3,701,528 A 10/1972 Ryan
3,805,834 A 4/1974 Bily
3,885,788 A 5/1975 Harris
4,402,500 A 9/1983 Coles
4,410,173 A * 10/1983 Bohme ..... 472/44
4,961,574 A 10/1990 Lew
5,342,244 A 8/1994 Nelson
5,391,115 A 2/1995 Bessey
5,658,201 A 8/1997 Kleimeyer
5,776,002 A * 7/1998 Weber ..... 472/110
5,803,815 A 9/1998 Kitchen
5,827,124 A * 10/1998 Kleimeyer et al. ..... 472/45
5,947,828 A * 9/1999 Fabbri ..... 472/30
5,951,406 A * 9/1999 Steane ..... 472/111
6,331,152 B1 * 12/2001 Holle ..... 482/4

OTHER PUBLICATIONS

Vegas.com: Sports & Rec: Recreation Guide.
Verticalwind.com FAQ's.

* cited by examiner

*Primary Examiner*—Kien Nguyen

(57) ABSTRACT

A system and method are disclosed for providing movement to a person having a person center of gravity and a person moment. The system includes a receptacle configured to allow the person to adjust the person center of gravity, a counterweight for counterbalancing the person moment, a beam connecting the receptacle and the counterweight, a base for supporting the beam, a base joint connecting the base and the beam, configured to allow the beam to rotate with respect to the base joint; wherein an adjustment in the person center of gravity provides rotation of the beam.

17 Claims, 12 Drawing Sheets

FLOATING MACHINE

CROSS REFERENCE TO RELATED APPLICATIONS

This application claims priority to U.S. Provisional Patent Application No. 60/351,068 entitled "AMUSEMENT MACHINE" filed Jan. 23, 2002 which is incorporated herein by reference for all purposes.

FIELD OF THE INVENTION

The present invention relates generally to machines that provide movements. More specifically, a machine that provides spatial movements for a person is disclosed.

BACKGROUND OF THE INVENTION

Many people have the desire to experience fight the way birds do—to have direct control over the movements, to feel the floating sensation without much burden. There are many devices that attempt to allow a person to experience flight or reduced gravity environments, but most fail to deliver the desired qualities of the flying experience.

Some of these devices partially counterbalance the rider through pulleys or counterweights, allowing them to jump and land as if they were in a lower gravity environment. However, once the rider has left the ground, the rider has no control over his motion. He can not, for instance, come close to the ground, and then choose to float upwards again without touching the ground.

Some other devices allow a user to control his elevation on a counterbalance arm by operating a mechanism that changes the location of a weight on the counterbalance arm. While these devices give the user some control, they do not provide a very natural or transparent interface to the user. Also, these devices generally allow the user to move in one plane and do not provide a full range of motion. It would be preferable if the user could control his motion by merely moving his body, without operating any mechanisms. In addition, it would be desirable for the user to have a full range of motion.

BRIEF DESCRIPTION OF THE DRAWINGS

The present invention will be readily understood by the following detailed description in conjunction with the accompanying drawings, wherein like reference numerals designate like structural elements, and in which.

DETAILED DESCRIPTION

It should be appreciated that the present invention can be implemented in numerous ways, including as a process, an apparatus, or a system. It should be noted that the order of the steps of disclosed processes may be altered within the scope of the invention.

A detailed description of one or more preferred embodiments of the invention is provided below along with accompanying figures that illustrate by way of example the principles of the invention. While the invention is described in connection with such embodiments, it should be understood that the invention is not limited to any embodiment. On the contrary, the scope of the invention is limited only by the appended claims and the invention encompasses numerous alternatives, modifications and equivalents. For the purpose of example, numerous specific details are set forth in the following description in order to provide a thorough understanding of the present invention. The present invention may be practiced according to the claims without some or all of these specific details. For the purpose of clarity, technical material that is known in the technical fields related to the invention has not been described in detail so that the present invention is not unnecessarily obscured.

An improved apparatus and method for providing motion are disclosed. In one embodiment, the apparatus is a machine that includes a beam connecting a receptacle and a counterweight. The receptacle is configured to support a person and allow the person to adjust his center of gravity. The machine is adjustable to achieve a state of neutral buoyancy. Adjustments in the person's center of gravity provide rotation of the beam, the receptacle, or both. The person can achieve controlled spatial movements without receiving an external force. There are many ways to adjust the system's moments. In some embodiments, the beam includes an extension arm. In some embodiments, the fulcrum of the beam is adjustable.

Figure 1:
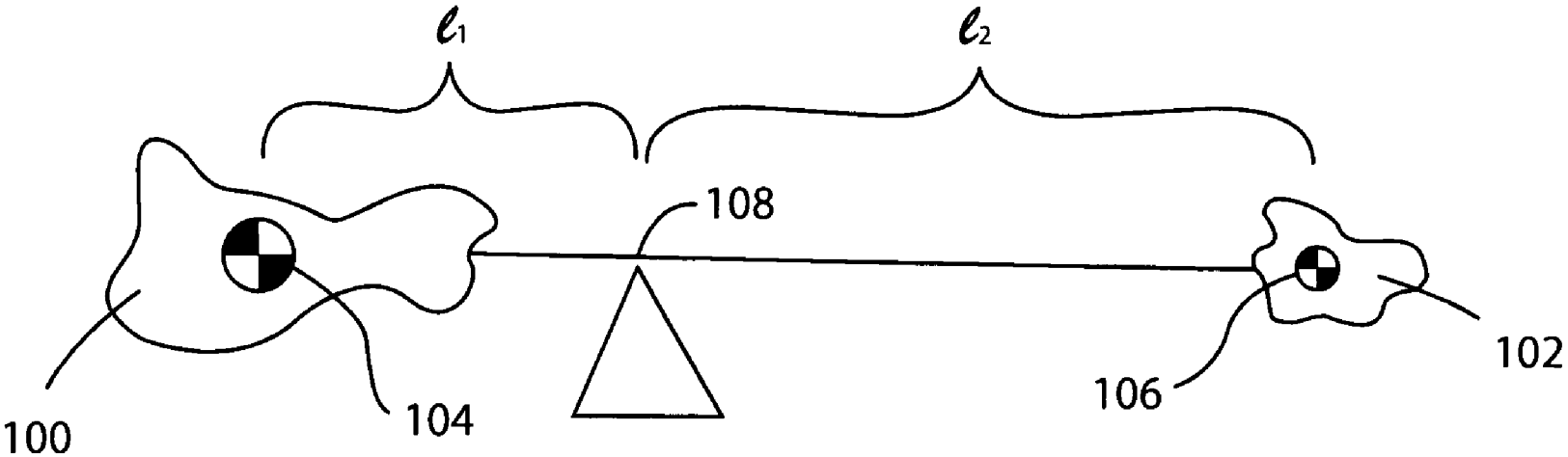
FIG. 1 is a diagram illustrating the operating principle of the present invention.

FIG. 1 is a diagram illustrating the operating principle of the present invention. Two objects, 100 and 102, are balanced on a beam supported at a fulcrum 108. Object 100 has a center of gravity at 104, and object 102 has a center of gravity at 106. The horizontal distance between 104 and the fulcrum is shown as L1, and the horizontal distance between 106 and the fulcrum is shown as L2.

The moment of an object is the product of the weight of the object and the horizontal distance between its center of gravity and the fulcrum. When the moment of the first object is equal to the moment of the second object, the system is neutrally buoyant. A neutrally buoyant system maintains a static state where the objects are stationary and balanced, or travel at a constant velocity. The neutral buoyancy of the system is disrupted when the moments of the objects become unbalanced. The moment of an object may change due to shifts in the position of the center of gravity or changes in the weight of the object. The disruption of the system's neutral buoyancy causes the objects to rotate with respect to the fulcrum, even absent of any external force.

Figure 2:
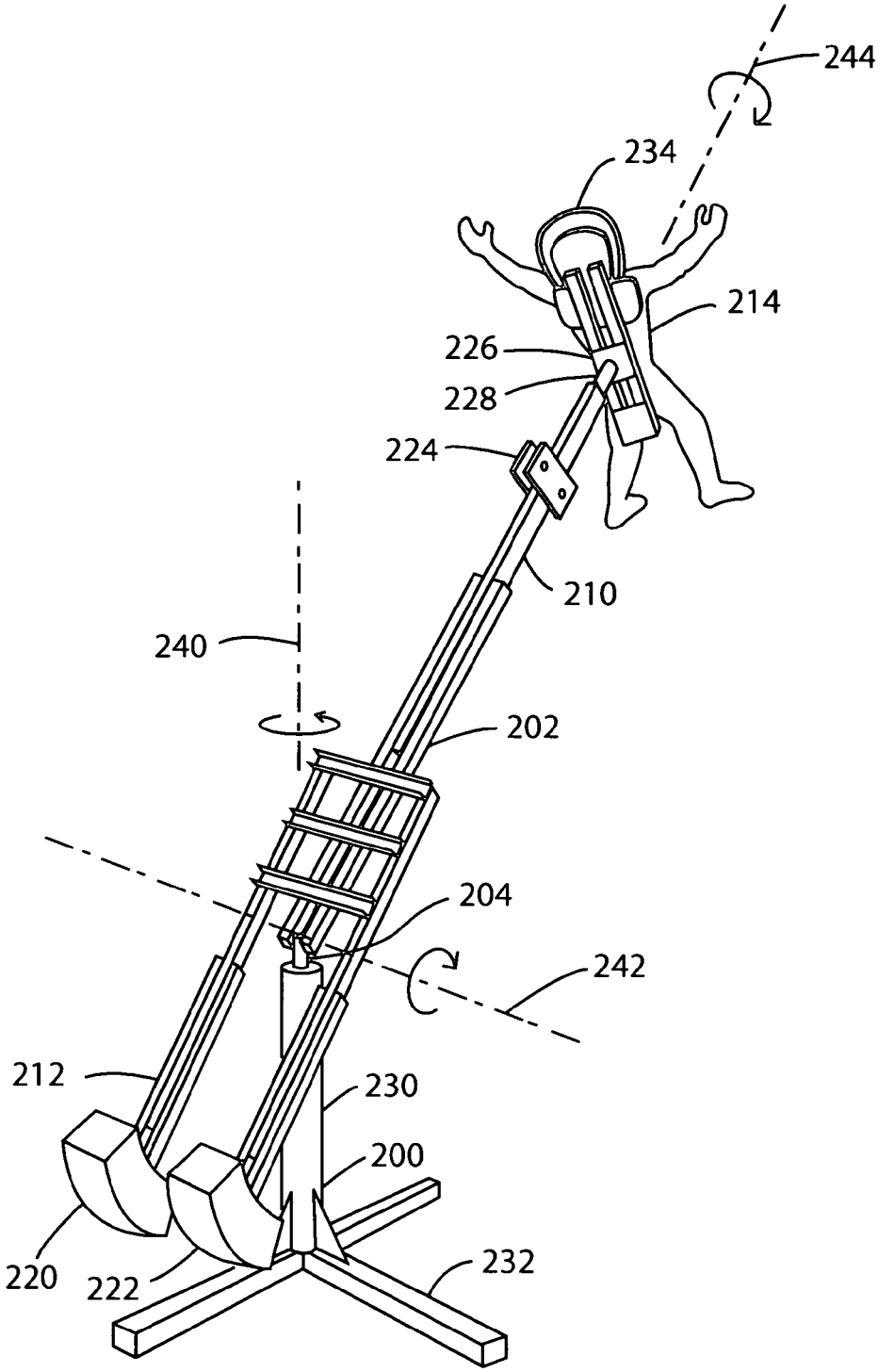
FIG. 2 is a diagram illustrating a machine for providing spatial movement to a person, according to one embodiment of the present invention.

FIG. 2 is a diagram illustrating a machine for providing spatial movement to a person, according to one embodiment of the present invention. The structure includes a base 200 and a beam 202. The beam is connected to the base at a base joint 204. The location of the base joint is the fulcrum of the beam. The base joint includes bearings that allow the beam to rotate. In this embodiment, the beam can rotate with respect to vertical axes such as 240 and horizontal axes such as 242. Thus, the base joint allows the beam and a receptacle 226 to rotate with respect to the base with two degrees of freedom, and allows the receptacle to travel on a surface that is approximately spherical.

In this embodiment, the beam includes an extension arm 210 and a counterweight support arm 212. On the end of the beam closer to the extension arm, there is a receptacle 226, used for supporting a person 214. The receptacle may be a harness, an enclosure, or any other appropriate contraption for supporting a person. In this embodiment, the receptacle includes a chair. The chair has straps and a roll bar 234 for safety purposes. The receptacle gives the person some freedom of movement and allows him to change his center of gravity; for example, the person can move his arms and legs. The receptacle is connected to the beam by a receptacle joint 228. This joint allows the person to rotate with respect to a beam axis 244. Thus, the receptacle and the person can rotate with respect to vertical axes such as 240, horizontal axes such as 242, and beam axis 244 in this embodiment. In some embodiments, the receptacle joint may allow the receptacle to rotate with respect to other axes to provide greater range of motion.

The person has a person center of gravity that, is at a horizontal distance L1 away from the base joint, and his person moment is the product of the person's weight and the horizontal distance L1. A counterweight is used to balance the person's weight. The counterweight includes two weight pieces 220 and 222 that are mounted to the forked ends of the counterweight support arm, and a fine adjustment weight 224 used to tune the counterweight moment. Note that for the purposes of clarity, the weight of the beam itself and the weight of the receptacle are considered negligible in this case. In some cases, these weights are significant and are part of the counterweight calculation.

The counterweight has a center of gravity at a horizontal distance L2 away from the base joint. The counterweight has a moment that provides counterbalance to the moment of the person. The machine is configurable to make the moment of the counterweight substantially equal to the moment of the person, thereby making the machine approximately neutrally buoyant. The machine is configurable to be approximately neutrally buoyant for people of different weights. There are many ways to adjust the moment of the counterweight or the moment of the person to achieve neutral buoyancy. In the embodiment shown, the extension arm is used to adjust the length of the beam and change the person's center of gravity. Also, the fine adjustable weight is used to change the moment of the counterweight. The fine adjustable weight is movable along the beam, and can be fastened at different positions to vary the center of gravity for the counterweight. The fine adjustable weight also includes additional parts that can be added or subtracted to change its weight. In some embodiments, the base joint is adjustable so that the position of the fulcrum is movable, thereby allowing changes in moments. In some embodiments, wearable weights are attached to the person to adjust his moment to achieve neutral buoyancy. In some embodiments, the mass and the positions of the weight pieces are configurable to change the moment of the counterweight.

In some embodiments, the weight pieces are heavy relative to the weight of the person. They are made of cement or any other dense material. When the person moves above the base, the forked structure allows the weight pieces to pass support structure 230 of the base. Thus, the forked structure enables the receptacle and the person to move in an uninterrupted arc over the top of the base.

The base includes a support structure 230 and a support 232. In some embodiments, the support structure is directly attached to the ground and the support is omitted. In some embodiments, the height of the support structure is adjustable. Different types of bases may be used to support the structure of the apparatus. For example, the base may include wheels so that machine can be moved.

In the embodiment shown, a person is strapped in the receptacle. After the system has been adjusted to be approximately neutrally buoyant, the person can shift his center of gravity to change his moment. The neutral buoyancy is thus disrupted and causes the receptacle to move. Since the rotational inertia of the system is high, movements tend to be slow and smooth. The resulting movement creates a sensation similar to being weightless and floating.

Figure 3C:
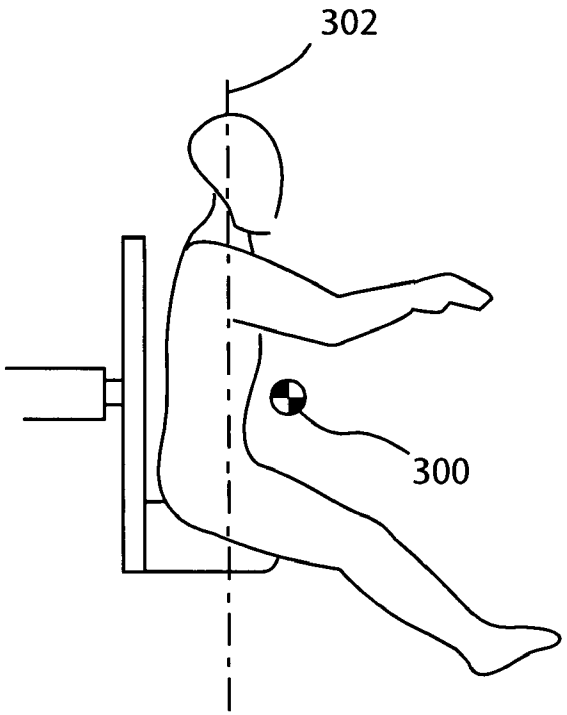
FIGS. 3A–3C are diagrams illustrating how a person creates movements by adjusting his center of gravity.
Figure 3B:
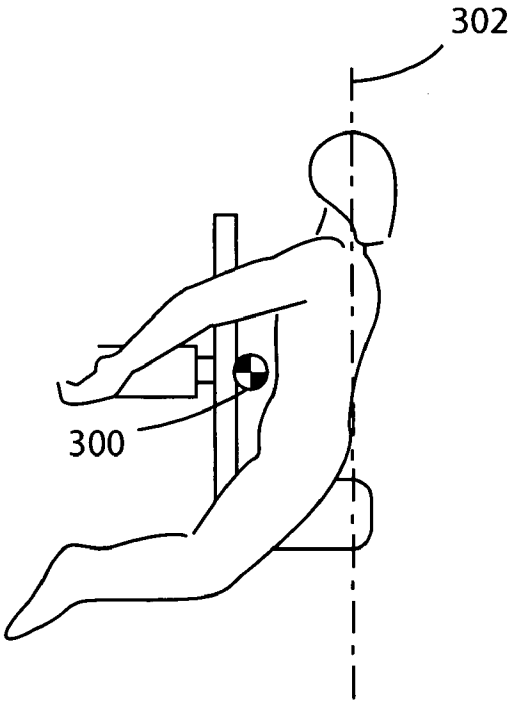
Figure 3A:
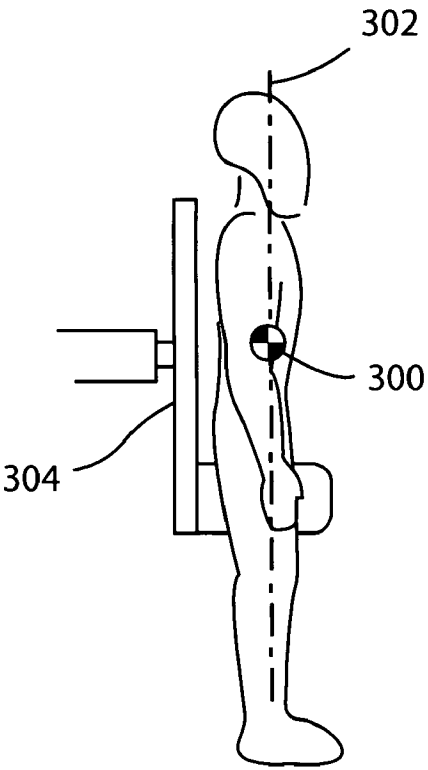

FIGS. 3A–3C are diagrams illustrating how a person creates movements by adjusting his center of gravity. FIG. 3A illustrates a person in a position with his arms and legs approximately perpendicular to the ground. He is strapped to receptacle 304. In this embodiment, he is facing away from the base of the machine. His center of gravity 300 is somewhere along an axis 302. This is often the position the person is in when the machine is first adjusted to achieve approximate neutral buoyancy.

In FIG. 3B, the person stretches his arms and legs behind his body, thereby shifting his center of gravity 300 to the left of axis 302. The distance between the person's center of gravity and the fulcrum is shortened, reducing the person's moment. Thus the neutral buoyancy is disrupted and the person experiences upward motion.

In FIG. 3C, the person stretches his arms and legs in front of his body, thereby shifting his center of gravity 300 to the right of axis 302. The distance between his center of gravity and the fulcrum is lengthened, increasing the person's moment. Thus, the neutral buoyancy is disrupted and the person experiences downward motion.

Figure 4B:
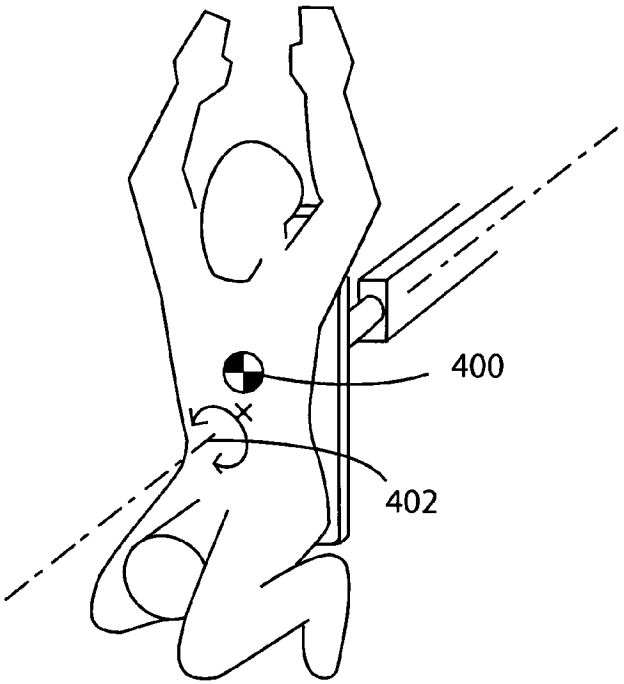
FIGS. 4A and 4B are diagrams illustrating the rotation of a person with respect to the axis along the beam (also referred to as the beam axis).
Figure 4A:
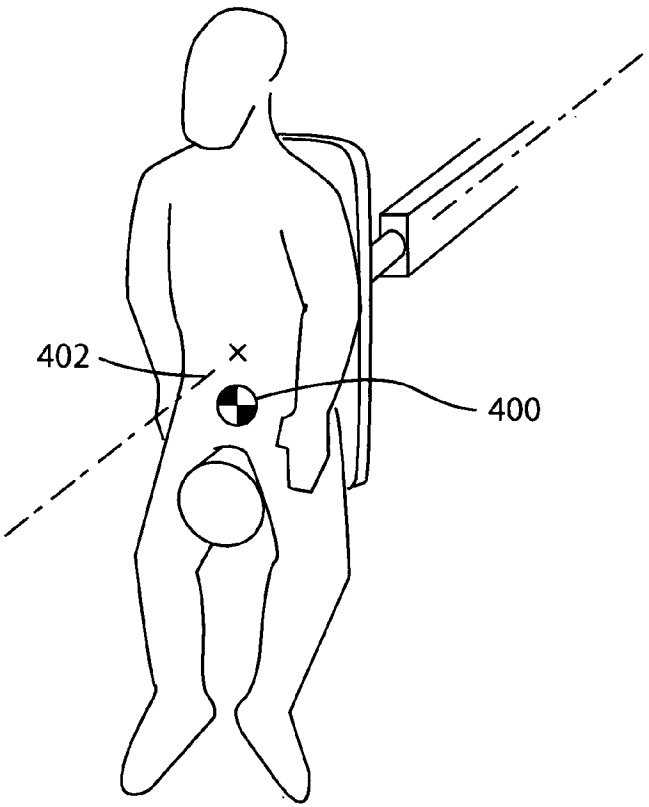

FIGS. 4A and 4B are diagrams illustrating the rotation of a person with respect to the axis along the beam (also referred to as the beam axis). The rotation is also caused by shifting the person's center of gravity. In FIG. 4A, the person's center of gravity 400 is below rotational axis 402 and the person is stable. In FIG. 4B, the person raises his arms and legs, causing his center of gravity to rise above the rotational axis, making the person unstable. Any slight offset of the center of gravity with respect to the rotational axis would cause the person to tip over and start rotating about the axis.

Figure 5C:
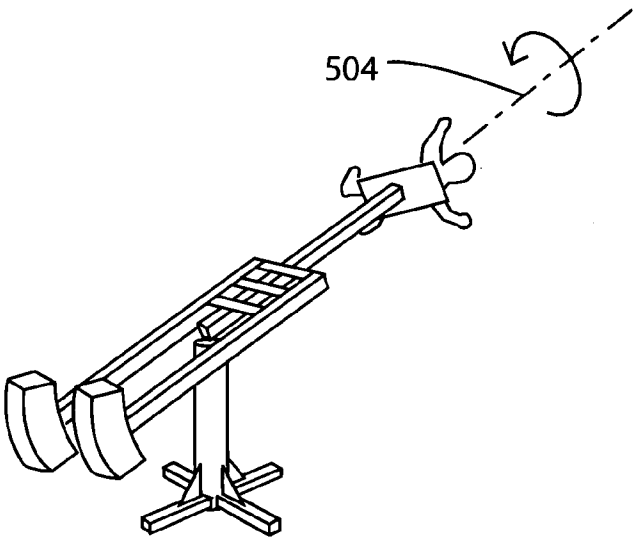
FIGS. 5A–5C are diagrams illustrating the range of motion the person has on a machine embodiment according to the present invention.
Figure 5B:
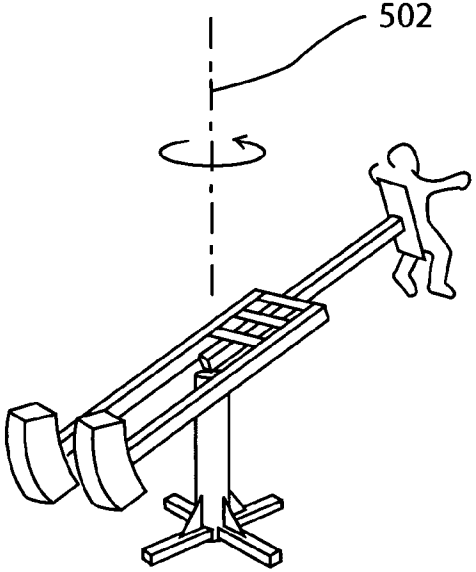
Figure 5A:
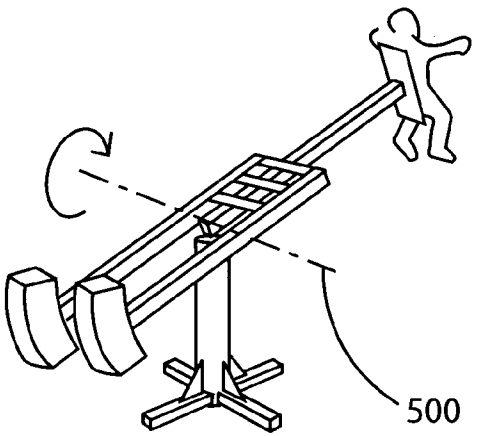

FIGS. 5A–5C are diagrams illustrating the range of motion the person has on a machine embodiment according to the present invention. In FIG. 5A, the person rotates about a horizontal rotational axis 500 by adjusting his center of gravity closer to or further from the base joint, using the methods shown in FIGS. 3A–3C. In FIG. 5B, the person rotates about a vertical rotational axis 502. The person can rotate about axis 502 by receiving an external force, such as pushing off an external surface or being pushed by other people. In addition, rotations about this axis can occur through conservation of angular momentum between the rotation of the person about the beam axis and the rotation of the beam about the rotational axis 502. FIG. 5C illustrates the rotation of the receptacle about a beam axis 504, using methods shown in FIGS. 4A–4B.

Figure 6:
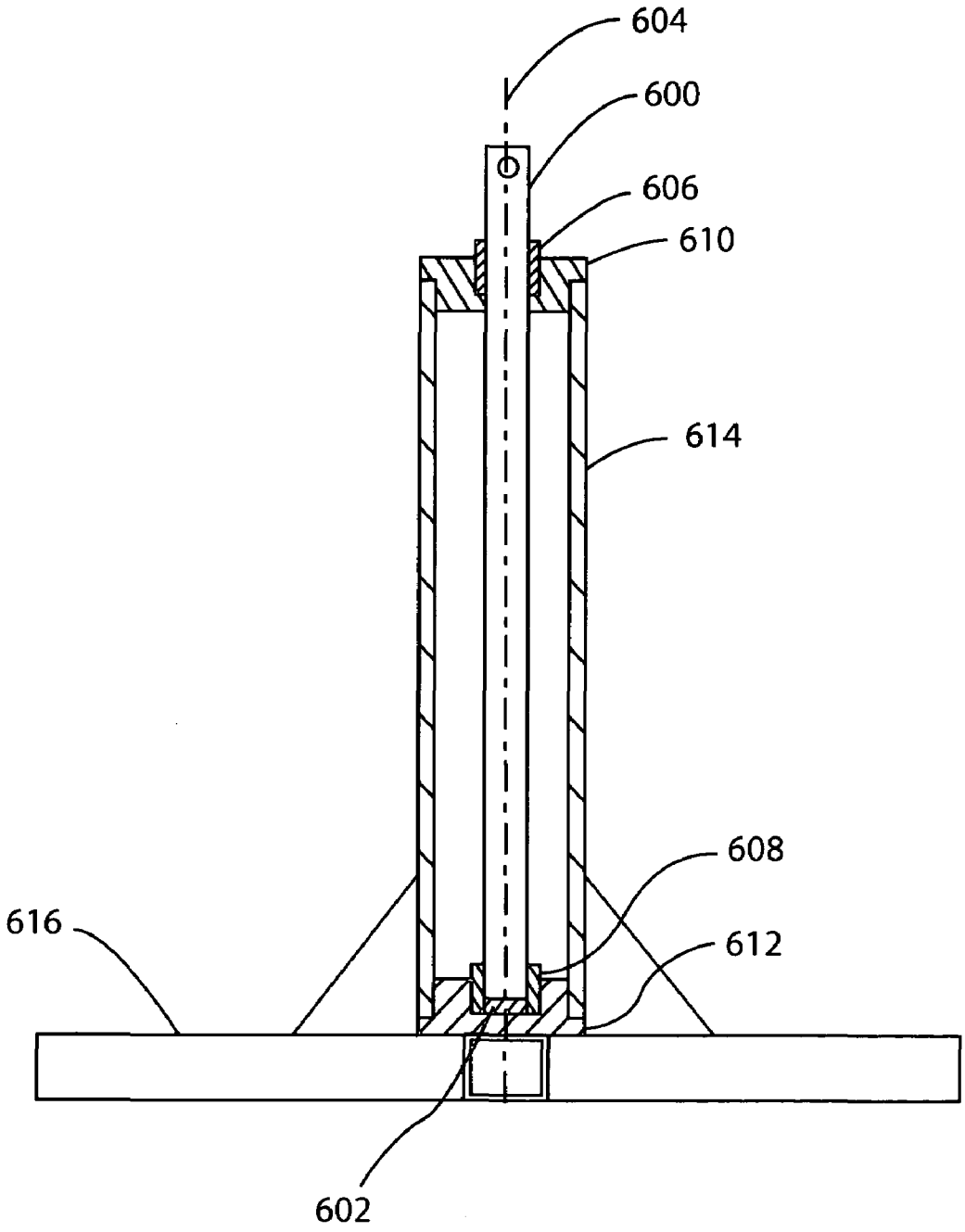
FIG. 6 is a cross-sectional diagram illustrating the details of the base according to one embodiment of the present invention.

FIG. 6 is a cross-sectional diagram illustrating the details of the base according to one embodiment of the present invention. The support structure portion of the base includes a load-bearing rod 600, which rests on a thrust bearing 602. The thrust bearing allows the load-bearing rod to rotate on a vertical axis 604. A top bushing 606 and a bottom bushing 608 are used to keep the load-bearing rod in place and to ensure that its rotational axis does not deviate significantly from axis 604. The top and bottom bushings are kept in top bushing housing 610 and bottom bushing housing 612, respectively. The bushing housings are mounted in a support structure 614. The support structure is generally made of sturdy and rigid material such as steel. It provides support for the bushings and bushing housings, and keeps the structures in place. The support structure and the bottom bushing housing are connected to a base 616. The base is designed to be wide and stable in order to keep the machine upright. In some embodiments, the support structure is directly connected to the ground and the base is omitted.

Figure 7:
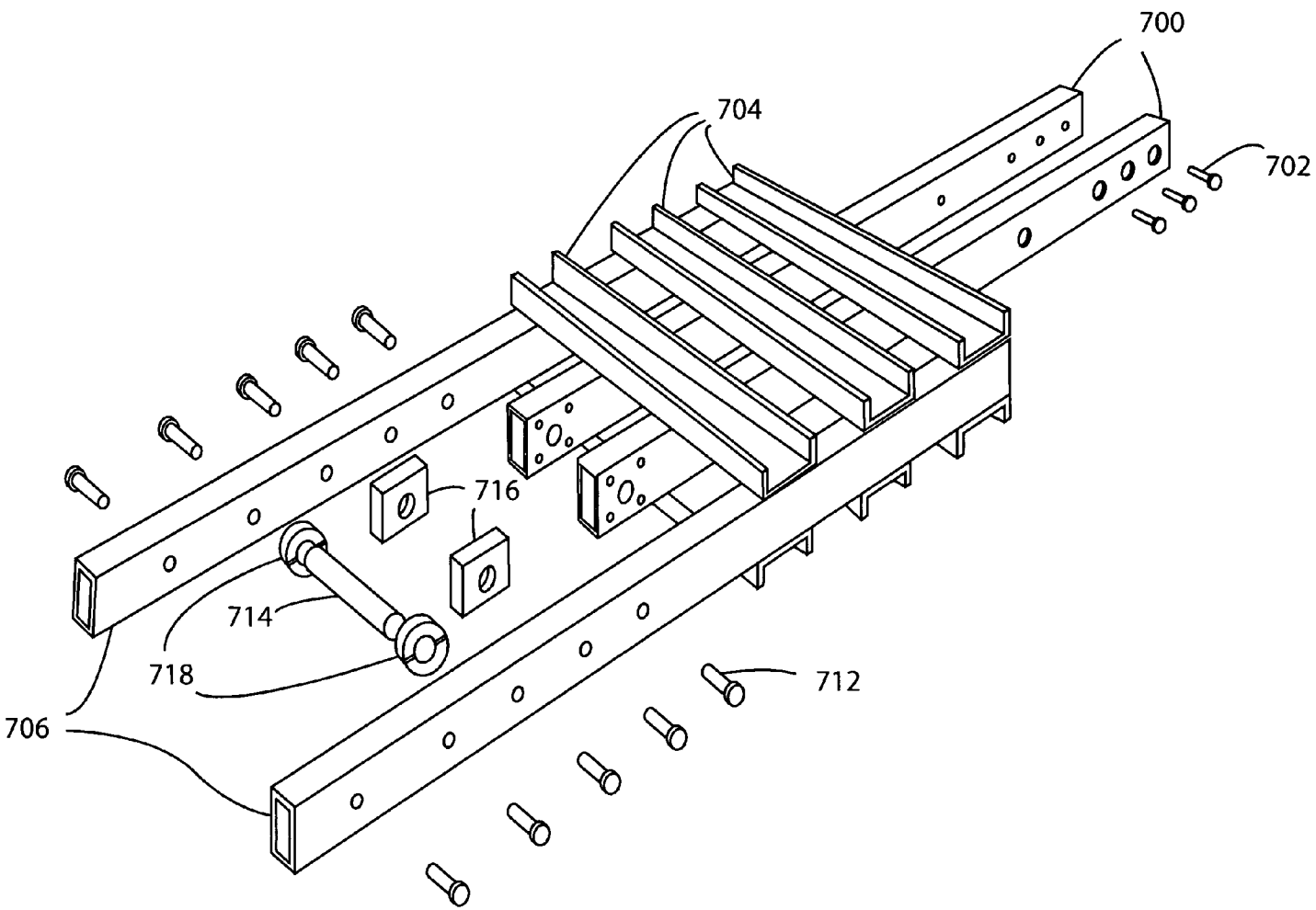
FIG. 7 is a diagram illustrating the details of the beam.

FIG. 7 is a diagram illustrating the details of the beam. The items labeled 700 are extension supports. The extension arm (not shown) is fastened to the extension supports by fasteners 702. Different types of fasteners, including bolts, clamps, quick-release fasteners or any other appropriate mechanism can be used. The extension supports are connected to counterweight supports 706 via a series of cross support bars 704. The weight mounting arms (not shown) are connected to the counterweight supports by fasteners 712. The beam is connected to the base by a base joint that includes a pin 714. The pin is connected to the beam at two ends of the extension supports, via bearings 716. Shaft collars 718 ensure that the pin stays in place.

Figure 8:
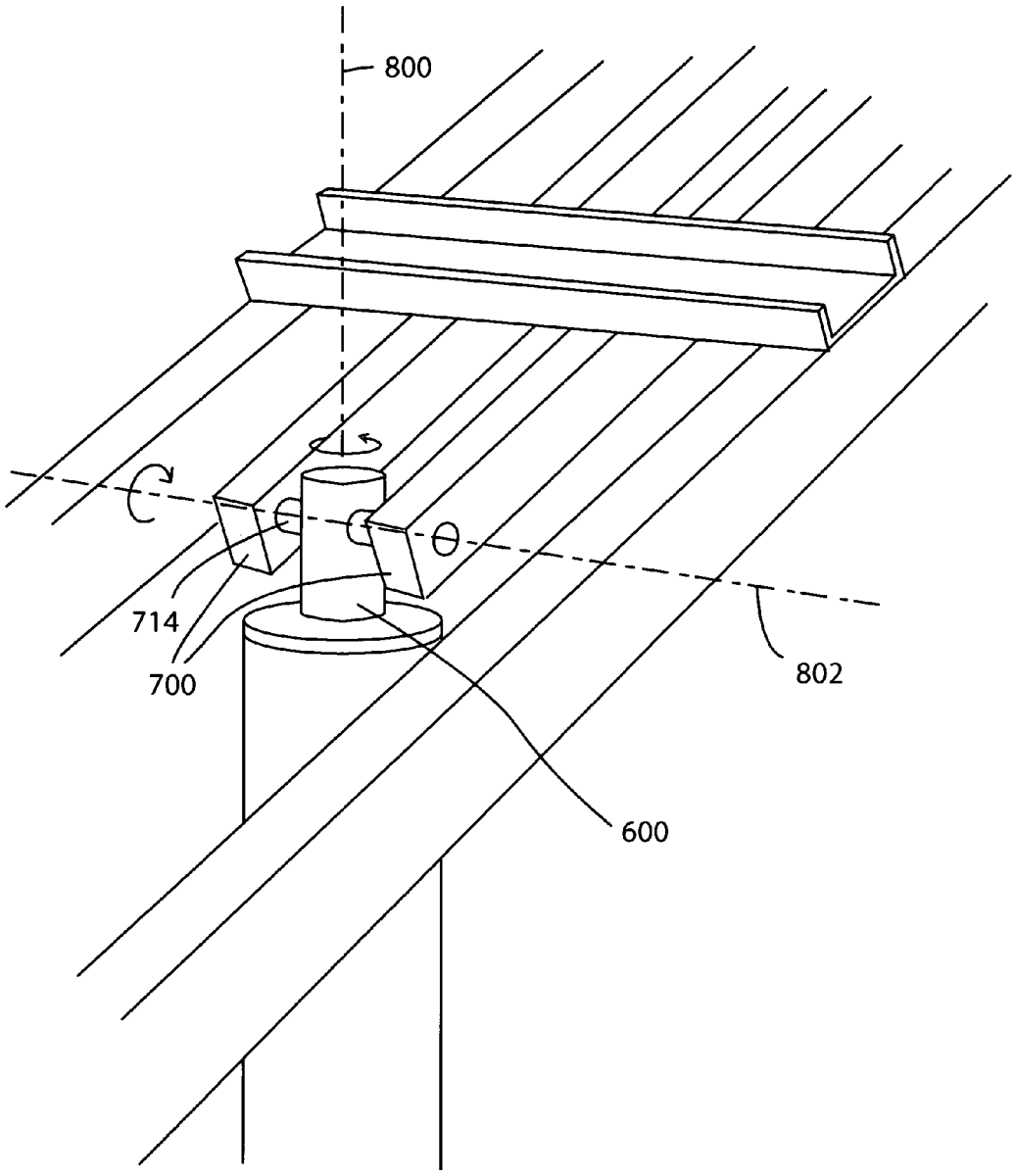
FIG. 8 is a diagram illustrating the base joint according to one embodiment of the present invention.

FIG. 8 is a diagram illustrating the base joint according to one embodiment of the present invention. The base joint includes rod 600 that allows the beam to freely rotate with respect to a vertical axis 800. Pin 714 is connected through the rod, to extension supports 700 via bearings housed inside the extension supports. The bearings allow the beam to freely rotate with respect to a horizontal axis 802.

Figure 9:
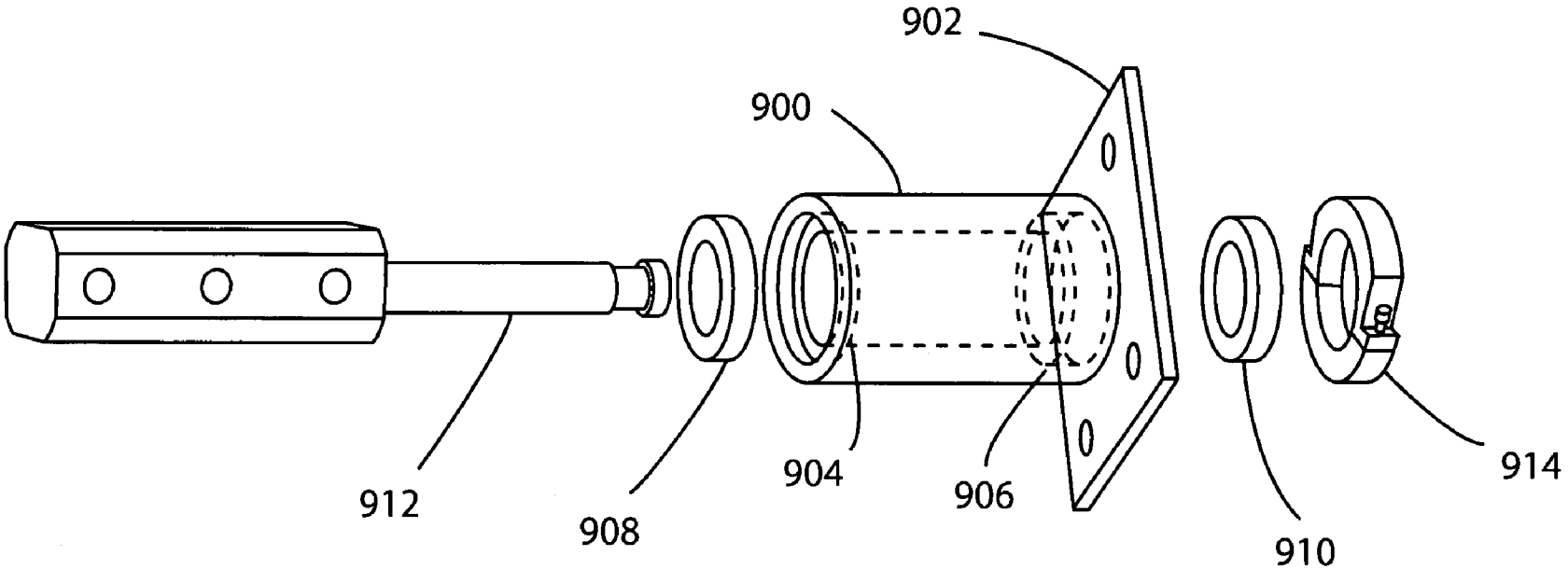
FIG. 9 is a diagram illustrating details of the receptacle joint according to one embodiment of the present invention.

FIG. 9 is a diagram illustrating details of the receptacle joint according to one embodiment of the present invention. The receptacle joint is used to connect the receptacle to the beam. It includes bearings that allow the receptacle to rotate. The receptacle joint includes an outer race 900 with a mounting flange 902 on one end. Close to the two openings of the race against the inner wall of the race are two stops 904 and 906 (shown in dashed lines) for positioning bearings fitted inside the race. Two angle bearings 908 and 910 are fitted into the race, held in position by the stops. The assembly is fitted over one end of a central shaft 912, and secured on the shaft with a shaft collar 914. The other end of the shaft is then secured to the extension arm. In some embodiments, there is a secondary containment over the shaft for added safety. In the event that the shaft breaks, the secondary containment will prevent the receptacle and person from falling off the machine.

Figure 10:
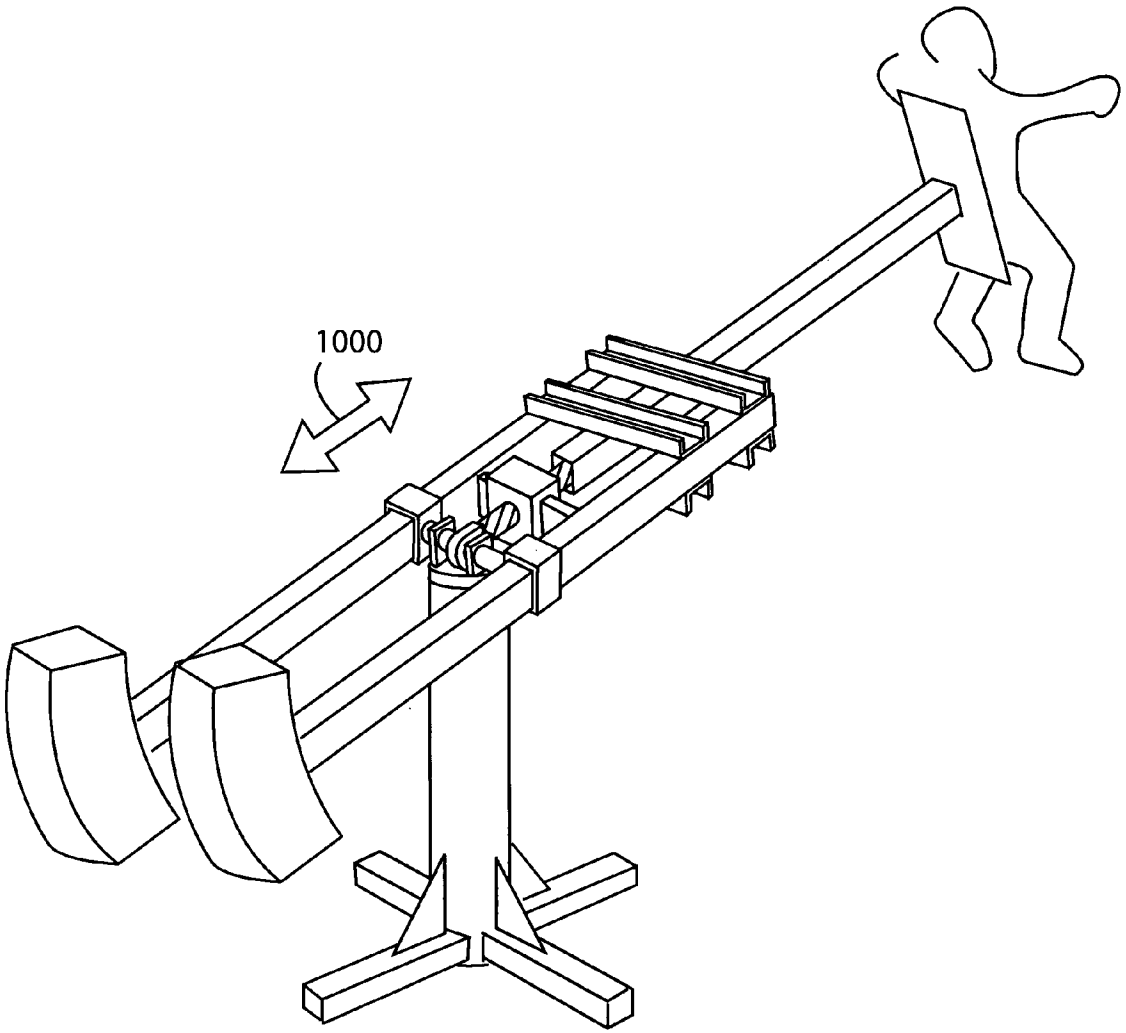
FIG. 10 is a diagram illustrating an embodiment of the present invention that has a base joint that allows for the adjustment of the fulcrum.

The moments of the system can be changed by adjusting the position of the fulcrum. FIG. 10 is a diagram illustrating an embodiment of the present invention that has a base joint that allows for the adjustment of the fulcrum. The base joint has attachments connected to the beam that allows the beam to be slid along the directions shown by arrow 1000. Being able to adjust the fulcrum is useful for balancing people of different body weights, as well as for easier loading and unloading of the person riding the device.

Figure 11:
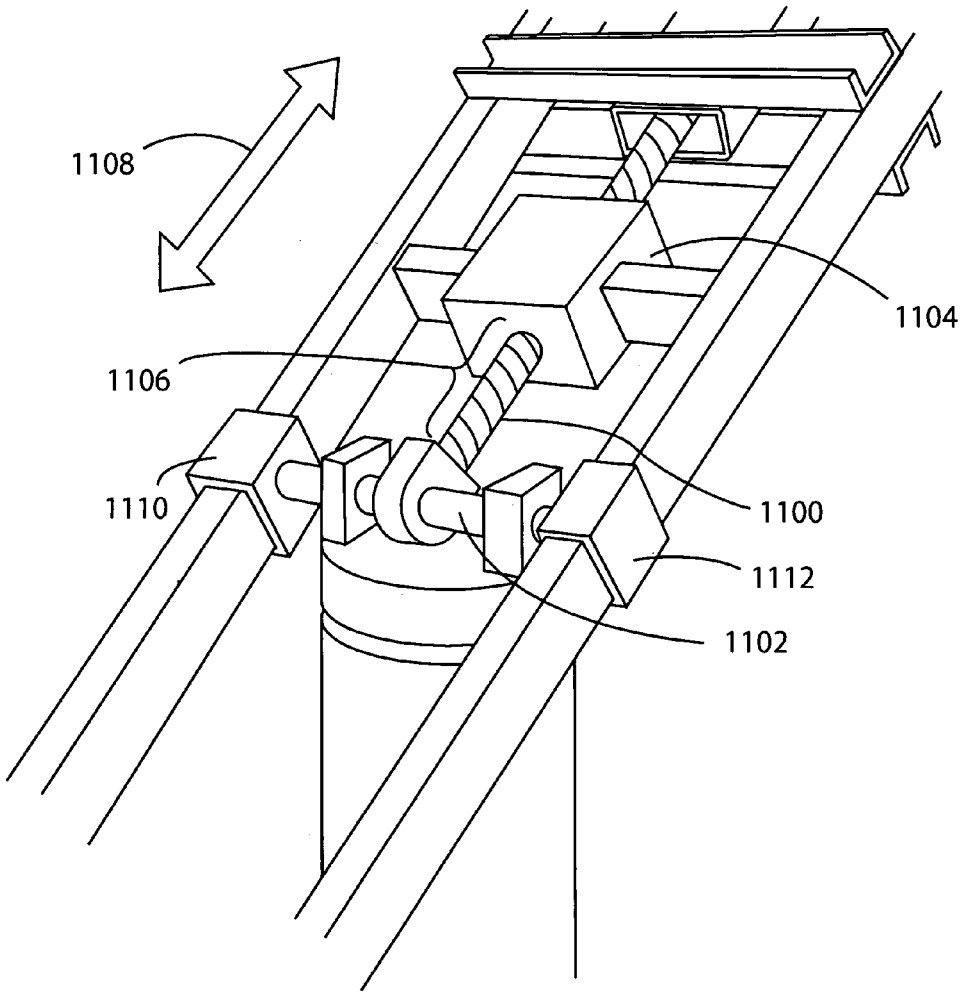
FIG. 11 is a diagram illustrating details of the base joint and its attachments, according to the machine embodiment shown in FIG. 10.

FIG. 11 is a diagram illustrating details of the base joint and its attachments, according to the machine embodiment shown in FIG. 10. A rigid leadscrew 1100 is attached to pin 1102. A driver motor 1104 is attached to the beam. The leadscrew is fitted through the threaded center portion of the driver motor. The driver motor is configurable to adjust the length of the section of the lead screw between the pin and the driver motor, labeled 1106. The leadscrew-driver motor combination allows the beam to move in directions shown by arrow 1108. Thus, the position of the fulcrum relative to the beam is adjustable. Once a desired fulcrum position has been reached, the beam is secured in place by two adjustable clamps 1110 and 1112.

Safety is an important consideration in the design. In some embodiments, the person is able to reach the ground and push off. If the person pushes off with too much force, the movement of the beam could be too fast to be safe. Thus, in some embodiments, one or more braking mechanisms such as brakes or governors are included to slow down the movement of the beam. In one embodiment, the braking mechanism includes a sensor that detects the speed of the movement, and a brake pad that engages once the detected speed exceeds a preset level. A brake may be located near any of the rotational axes for added safety.

Figure 12:
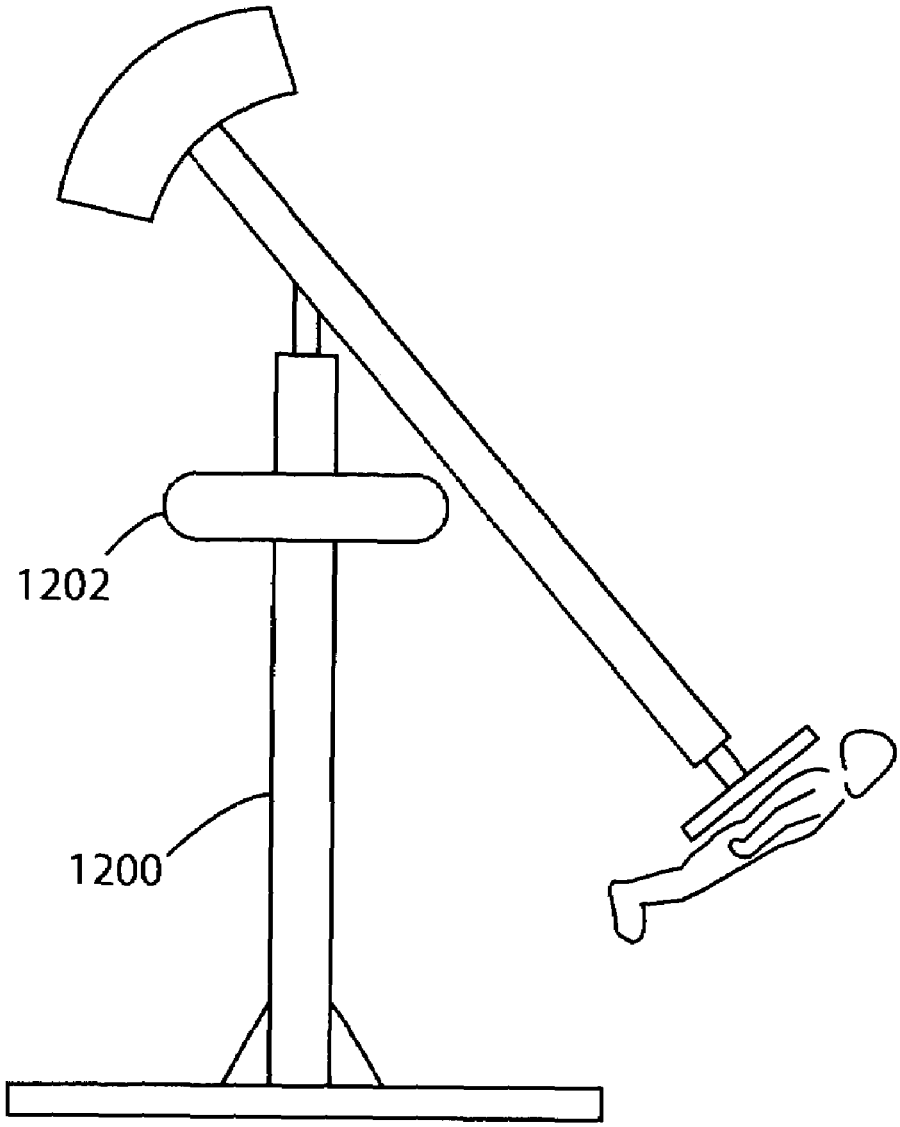
FIG. 12 is a diagram illustrating an embodiment of the present invention with additional safety features.

FIG. 12 is a diagram illustrating an embodiment of the present invention with additional safety features. Support structure 1200 is extendable, and is initially lowered to a level that allows the person to stand on the ground while the system is adjusted to achieve neutral buoyancy. During operation, the support structure is raised to a level where the person cannot touch the ground. The extendable support structure can be implemented using hydraulics or other appropriate mechanical systems. The support structure also includes a stop 1202 that prevents the extension arm and the person from running into the support structure. In some embodiments, the stop is attached to the extension arm. In some embodiments, the support structure is tall but not adjustable. Initially, the person stands on a loading platform and the system is adjusted to achieve neutral buoyancy. The loading platform is then moved out of the way and the person can move around without touching the ground.

An improved apparatus and method for providing motion has been disclosed. The apparatus is a machine that includes a beam connecting a receptacle for supporting a person, and a counterweight. The machine can be adjusted to achieve a state of neutral buoyancy. Shifts in the person's center of gravity provide motion. Thus, the person can achieve smooth, controlled spatial movements without receiving an external force. A beautiful, dreamlike floating sensation is achieved through the movements.

Although the foregoing invention has been described in some detail for purposes of clarity of understanding, it will be apparent that certain changes and modifications may be practiced within the scope of the appended claims. It should be noted that there are many alternative ways of implementing both the process and apparatus of the present invention. Accordingly, the present embodiments are to be considered as illustrative and not restrictive, and the invention is not to be limited to the details given herein, but may be modified within the scope and equivalents of the appended claims.

What is claimed is:

1. A machine for supporting a person having a person center of gravity and a person moment, including:

a receptacle configured to allow the person to adjust the person center of gravity;

a counterweight for counterbalancing the person moment, having a counterweight center of gravity and a counterweight moment;

a beam connecting the receptacle and the counterweight, having a fulcrum;

a base for supporting the beam;

a base joint connecting the base and the beam, configured to allow the beam to rotate with respect to the base joint;

wherein:

an adjustment in the person center of gravity provides rotation of the beam;

the beam includes an extension arm for adjusting a distance between the person and the base joint;

the adjustment in the person center of gravity further provides rotation of the receptacle;

and the receptacle is capable of rotating with respect to a horizontal axis, a vertical axis and a beam axis.

2. A machine for supporting a person having a person center of gravity and a person moment, including:

a receptacle configured to allow the person to adjust the person center of gravity;

a counterweight for counterbalancing the person moment, having a counterweight center of gravity and a counterweight moment;

a beam connecting the receptacle and the counterweight, having a fulcrum;

a base for supporting the beam;

a base joint connecting the base and the beam, configured to allow the beam to rotate with respect to the base joint; and a wearable weight attached to the person for adjusting the person moment;

wherein an adjustment in the person center of gravity provides rotation of the beam.

3. A machine for supporting a person having a person center of gravity and a person moment, including:

a receptacle configured to allow the person to adjust the person center of gravity;

a counterweight for counterbalancing the person moment, having a counterweight center of gravity and a counterweight moment;

a beam connecting the receptacle and the counterweight, having a fulcrum;

a base for supporting the beam;

a base joint connecting the base and the beam, configured to allow the beam to rotate with respect to the base joint;

wherein an adjustment in the person center of gravity provides rotation of the beam; and the receptacle is configured to allow rotation with respect to a horizontal axis, a vertical axis and a beam axis.

4. A machine for supporting a person as recited in claim 3 wherein the base joint allows the beam to rotate with respect to a horizontal axis and a vertical axis.

5. A machine for supporting a person as recited in claim 3 wherein the counterweight moment is adjustable.

6. A machine for supporting a person as recited in claim 3 wherein the receptacle is connected to the beam via a receptacle joint; and the receptacle joint allows the receptacle to rotate.

7. A machine for supporting a person as recited in claim 3 wherein the receptacle includes a roll bar for providing safety.

8. A machine for supporting a person as recited in claim 3 wherein the counterweight includes a fine adjustment weight for tuning the counterweight moment.

9. A machine for supporting a person as recited in claim 3 wherein the beam is configurable to be approximately neutrally buoyant.

10. A machine for supporting a person as recited in claim 3 wherein the beam is configurable to be approximately neutrally buoyant for people of different weights.

11. A machine for supporting a person as recited in claim 3 wherein the beam is configurable to achieve a state of approximate neutral buoyancy; and disruption in the state of approximate neutral buoyancy causes movement of the receptacle.

12. A machine for supporting a person as recited in claim 3 wherein the beam includes a forked end for mounting the counterweight.

13. A machine for supporting a person as recited in claim 3 wherein the beam is configured to allow the person to move in an uninterrupted arc over top of the base.

14. A machine for supporting a person as recited in claim 3 wherein the counterweight includes a plurality of weight pieces.

15. A machine for supporting a person as recited in claim 3 wherein the base joint is adjustable to allow position changes of the fulcrum.

16. A machine for supporting a person as recited in claim 3 wherein the receptacle joint includes an angle bearing.

17. A machine for supporting a person as recited in claim 3 further including a breaking mechanism for slowing down movement of the beam.

* * * * *